US008247144B2

(12) United States Patent
Koike et al.

(10) Patent No.: US 8,247,144 B2
(45) Date of Patent: Aug. 21, 2012

(54) PHOTORECEPTOR FOR ELECTROPHOTOGRAPHY

(75) Inventors: Makoto Koike, Fukushima (JP); Katsumi Abe, Fukushima (JP); Atsushi Takesue, Fukushima (JP)

(73) Assignee: Hodogaya Chemical Co., Ltd., Tokyo (JP)

( * ) Notice: Subject to any disclaimer, the term of this patent is extended or adjusted under 35 U.S.C. 154(b) by 463 days.

(21) Appl. No.: 12/524,213

(22) PCT Filed: Jan. 24, 2008

(86) PCT No.: PCT/JP2008/050989

§ 371 (c)(1),
(2), (4) Date: Sep. 14, 2009

(87) PCT Pub. No.: WO2008/090955

PCT Pub. Date: Jul. 31, 2008

(65) Prior Publication Data

US 2010/0104964 A1 Apr. 29, 2010

(30) Foreign Application Priority Data

Jan. 25, 2007 (JP) ..... P.2007-014848

(51) Int. Cl.
*G03G 5/06* (2006.01)

(52) U.S. Cl. ..... 430/75; 430/58.15

(58) Field of Classification Search ..... 430/75, 430/58.15, 59.1, 58.45
See application file for complete search history.

(56) References Cited

U.S. PATENT DOCUMENTS 5,824,808 A 10/1998 Hori et al.
6,335,132 B1 * 1/2002 Tanaka et al. ..... 430/59.3
(Continued)

FOREIGN PATENT DOCUMENTS

EP 1038871 A1 * 9/2000
(Continued)

OTHER PUBLICATIONS

European Search Report for European Application No. 08703816.2, mailed Oct. 25, 2011.

*Primary Examiner* — Christopher Rodee
(74) *Attorney, Agent, or Firm* — Greenblum and Bernstein, P.L.C.

(57) ABSTRACT

An object of the invention is to provide a photoreceptor for electrophotography which has a low residual potential in an initial stage, is inhibited from increasing in residual potential, is prevented from decreasing in charge potential, and undergoes little fatigue deterioration even upon repeated use. The invention relates to a photoreceptor for electrophotography which has a photosensitive layer containing a cyclic phenol sulfide represented by the following general formula (1):

[Chem. 1]

and one or more charge-transporting agents each having an arylamino group in the molecule, and which has excellent durability.

10 Claims, 3 Drawing Sheets

U.S. PATENT DOCUMENTS

| | | | | |
|---|---|---|---|---|
| 6,773,856 | B2 * | 8/2004 | Tanaka et al. | 430/59.2 |
| 7,709,172 | B2 * | 5/2010 | Yasumura et al. | 430/108.5 |
| 7,901,858 | B2 * | 3/2011 | Yasumura et al. | 430/108.5 |
| 2004/0063017 | A1 | 4/2004 | Lee et al. | |
| 2006/0172208 | A1 * | 8/2006 | Tanaka et al. | 430/59.4 |
| 2009/0029277 | A1 * | 1/2009 | Okuda et al. | 430/96 |

FOREIGN PATENT DOCUMENTS

| | | | |
|---|---|---|---|
| EP | 1 310 830 | | 5/2003 |
| JP | 53-138229 | | 2/1978 |
| JP | 53-095033 | | 8/1978 |
| JP | 53-132347 | | 11/1978 |
| JP | 53-133345 | | 11/1978 |
| JP | 54-002129 | | 1/1979 |
| JP | 54-012742 | | 1/1979 |
| JP | 54-017733 | | 2/1979 |
| JP | 54-017734 | | 2/1979 |
| JP | 54-021728 | | 2/1979 |
| JP | 54-022834 | | 2/1979 |
| JP | 57-195767 | | 12/1982 |
| JP | 57-195768 | | 12/1982 |
| JP | 57-202545 | | 12/1982 |
| JP | 58-222152 | | 12/1983 |
| JP | 59-129857 | | 7/1984 |
| JP | 59-136351 | | 8/1984 |
| JP | 60-172044 | | 9/1985 |
| JP | 62-247374 | | 10/1987 |
| JP | 62-267363 | | 11/1987 |
| JP | 63-148263 | | 6/1988 |
| JP | 64-044946 | | 2/1989 |
| JP | 64-079753 | | 3/1989 |
| JP | 01-118845 | | 5/1989 |
| JP | 02-254459 | | 10/1990 |
| JP | 5-323632 | | 7/1993 |
| JP | 6-80895 | | 3/1994 |
| JP | 07-126225 | | 5/1995 |
| JP | 08-211636 | | 8/1996 |
| JP | 09-202762 | | 8/1997 |
| JP | 09-227533 | | 9/1997 |
| JP | 9-227553 | | 9/1997 |
| JP | 2002-229228 | | 8/2002 |
| JP | 2003-295522 | | 10/2003 |
| JP | 2003295522 | A * | 10/2003 |
| JP | 2004-62211 | | 2/2004 |
| JP | 2004-93797 | | 3/2004 |
| WO | WO 98/09959 | | 3/1998 |
| WO | WO 9919427 | A1 * | 4/1999 |
| WO | WO 99/29683 | | 6/1999 |

* cited by examiner

PHOTORECEPTOR FOR ELECTROPHOTOGRAPHY

TECHNICAL FIELD

The present invention relates to a photoreceptor for electrophotography. More particularly, the invention relates to a photoreceptor for electrophotography which changes little in charge potential and residual potential even upon repeated use and has excellent durability.

BACKGROUND ART

Inorganic photoconductive substances such as selenium, zinc oxide, cadmium sulfide, and silicon have hitherto been used extensively in photoreceptors for electrophotography. Although these inorganic substances have many merits, they had various drawbacks. For example, selenium has drawbacks that it necessities difficult production conditions and that selenium is apt to crystallize with heat or mechanical impact. Zinc oxide and cadmium sulfide have problems concerning moisture resistance and mechanical strength and further have a drawback that these substances deteriorate in suitability for charge or exposure by the action of a dye added as a sensitizer, resulting in poor durability. Silicon also necessitates difficult production conditions and further necessitates use of a highly irritant gas, resulting in a high cost. Silicon is sensitive to moisture and, hence, care should be taken in handling. In addition, selenium and cadmium sulfide have a problem concerning toxicity.

Organic photoreceptors which employ various organic compounds and in which those drawbacks of inorganic photoreceptors have been mitigated are in extensive use. The organic photoreceptors include: single-layer type photoreceptors in which a charge-generating agent and a charge-transporting agent have been dispersed in a binder resin; and multilayer type photoreceptors in which functions have been allotted to a charge-generating layer and a charge-transporting layer. A feature of the latter photoreceptors, which are called the function allocation type, resides in that materials suitable for the respective functions can be selected from a wide range. Because a photoreceptor having any desired performances can be easily produced, many investigations on that type have been made.

Various improvements such as development of novel materials and combinations of these have been made in order to satisfy the performances required of photoreceptors for electrophotography, such as basic performances and high durability, as described above. However, a satisfactory photoreceptor has not been obtained so far.

Although organic materials have many merits not possessed by inorganic materials, no organic photoreceptor which satisfies all the properties required of photoreceptors for electrophotography has been obtained so far. Namely, organic photoreceptors suffer a decrease in charge potential, increase in residual potential, change in sensitivity, etc. due to repeated use and this results in deterioration in image quality. Although the causes of this deterioration have not been fully elucidated, decomposition or the like of the charge-transporting agent, etc. caused by: the active gases generating upon charge by corona discharge, such as ozone and $NO_X$; the ultraviolet contained in the exposure light and erase light; and heat are considered to serve as some factors. Known techniques for inhibiting such deterioration include a technique in which a hydrazone compound is used in combination with an antioxidant (see, for example, patent document 1) and a technique in which a butadiene compound is used in combination with an antioxidant (see, for example, patent document 2). However, photoreceptors having satisfactory initial sensitivity are not sufficiently inhibited from deteriorating with repeated use, while ones reduced in deterioration with repeated use have problems concerning initial sensitivity and electrification characteristics. Furthermore, even the technique in which a calixarene compound is added (see, for example, patent document 3) has not produced a sufficient effect. As described above, the effect of inhibiting the deterioration has not been sufficiently obtained so far.

Patent Document 1: JP-A-1-044946

Patent Document 2: JP-A-1-118845

Patent Document 3: JP-A-5-323632

DISCLOSURE OF THE INVENTION

Problems that the Invention is to Solve

Accordingly, an object of the invention is to provide a photoreceptor for electrophotography which employs a charge-transporting agent having an arylamino group in the molecule and which has a low residual potential in an initial stage, is inhibited from increasing in residual potential, is prevented from decreasing in charge potential, and undergoes little fatigue deterioration even upon repeated use.

Means for Solving the Problems

The invention provides a photoreceptor for electrophotography, which comprises a conductive support and a photosensitive layer formed on the support, the photosensitive layer containing a cyclic phenol sulfide represented by the following general formula (1):

[Chem. 1]

(1)

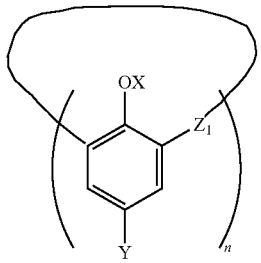

(wherein X is a hydrogen atom, a hydrocarbon group, or an acyl group; Y is a hydrogen atom, a hydrocarbon group, a halogenated hydrocarbon group, —COR1, —OR2, —COOR3, —CN, —$CONH_2$, —$NO_2$, —NR4R5, a halogen atom, —$SO_4$R6, or —$SO_3$R7, wherein R1, R2, R3, R4, R5, R6, and R7 each are a hydrogen atom or a hydrocarbon group; Z1 is a substituent selected from S, a sulfinyl group, and a sulfonyl group; n is an integer of 4-12; and the plural X's, the plural Y's, and the plural Z1's each may be the same or different) and one or more charge-transporting agents each having an arylamino group in the molecule.

It is preferred that the photosensitive layer of the photoreceptor for electrophotography of the invention should contain, as the charge-transporting agents having an arylamino group in the molecule, one or more hydrazone compounds represented by the following general formula (2), (3), or (4):

[Chem. 2]

(2)

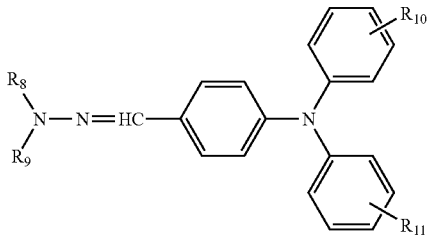

(wherein R8 and R9 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; and R10 and R11 may be the same or different and each represent a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; provided that when R8 to R11 further have a substituent, then the substituent may be a halogen atom, alkoxy group, aryloxy group, dialkylamino group, or alkylthio group, and that R8 or R9 may further have an alkyl group only when it is an aryl group);

[Chem. 3]

(3)

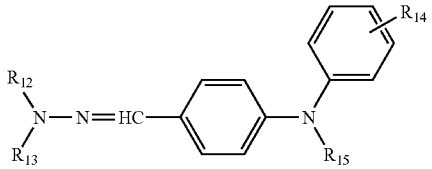

(wherein R12 and R13 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; R14 represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and R15 represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when R12 to R15 further have a substituent, then the substituent may be a halogen atom, alkoxy group, aryloxy group, dialkylamino group, or alkylthio group, and that R12 or R13 may further have an alkyl group only when it is an aryl group);

[Chem. 4]

(4)

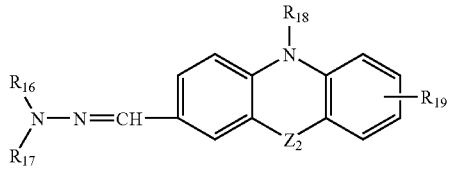

(wherein Z2 represents O, S, or a divalent group represented by N(R18); R16 and R17 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; R19 represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and R18 represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when R16 to R19 further have a substituent, then the substituent may be a halogen atom, alkoxy group, aryloxy group, dialkylamino group, or alkylthio group, and that R16 or R17 may further have an alkyl group only when it is an aryl group).

It is alternatively preferred that the photosensitive layer of the photoreceptor for electrophotography of the invention should contain, as the charge-transporting agents having an arylamino group in the molecule, one or more styryl compounds represented by the following general formula (5):

[Chem. 5]

(5)

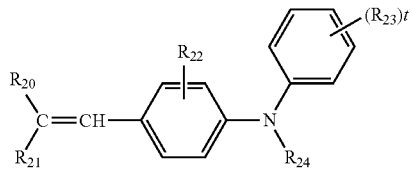

(wherein R20 and R21 may be the same or different and each represent a substituted or unsubstituted phenyl group, a substituted or unsubstituted naphthyl group, a substituted or unsubstituted anthryl group, a substituted or unsubstituted fluorenyl group, or a substituted or unsubstituted heterocyclic group, the substituents being any of an alkyl group, alkoxy group, halogen atom, hydroxyl group, and phenyl group, each of which may be further substituted; R22 represents hydrogen, a halogen atom, an alkyl group having 1-8 carbon atoms, an alkoxy group having 1-8 carbon atoms, or a mono- or dialkylamino group; R23 represents a hydrogen atom, an alkyl group having 1-8 carbon atoms, an alkoxy group having 1-8 carbon atoms, a halogen atom, or a mono- or di-substituted amino group; t is an integer of 1 or 2; when t=2, then the two substituents may be the same or different and the two substituents may be bonded to each other to form a tetramethylene ring or trimethylene ring; and R24 represents a substituted or unsubstituted phenyl group, the substituent being any of an alkyl group, alkoxy group, halogen atom, hydroxyl group, and substituted or unsubstituted phenyl group, each of which may be further substituted).

It is alternatively preferred that the photosensitive layer of the photoreceptor for electrophotography of the invention should contain, as the charge-transporting agents having an arylamino group in the molecule, one or more benzidine compounds represented by the following general formula (6):

[Chem. 6]

(6)

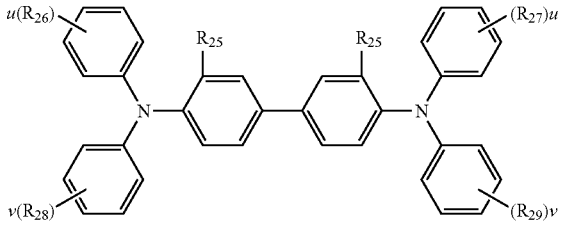

(wherein R25 represents a hydrogen atom, an alkyl group having 1-8 carbon atoms, an alkoxy group having 1-8 carbon atoms, or a halogen atom; R26, R27, R28, and R29 may be the same or different and each represent a hydrogen atom, an alkyl group having 1-8 carbon atoms, an alkoxy group having 1-8 carbon atoms, a halogen atom, or a mono- or di-substituted amino group; u is an integer of 1 or 2; when u=2, then the two substituents bonded to the same phenyl group may be the same or different; v is an integer of 1 or 2; and when v=2, then the two substituents bonded to the same phenyl group may be the same or different).

It is alternatively preferred that the photosensitive layer of the photoreceptor for electrophotography of the invention should contain, as the charge-transporting agents having an arylamino group in the molecule, one or more p-terphenyl compounds represented by the following general formula (7):

[Chem. 7]

(7)

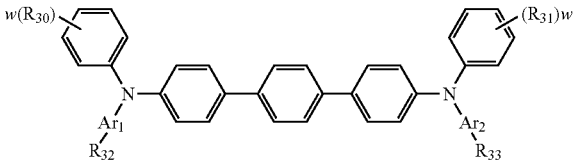

(wherein R30 and R31 may be the same or different and each represent a hydrogen atom, an alkyl group having 1-8 carbon atoms, an alkoxy group having 1-8 carbon atoms, a halogen atom, or a mono- or di-substituted amino group; w is an integer of 1 or 2; when w=2, then the two substituents bonded to the same phenyl group may be the same or different; Ar1 and Ar2 may be the same or different and each represent a substituted or unsubstituted divalent aromatic hydrocarbon group; and R32 and R33 each represent a hydrogen atom, an alkyl group having 1-8 carbon atoms, an alkoxy group having 1-8 carbon atoms, a substituted or unsubstituted aralkyl group, a halogen atom, or a di-substituted amino group).

In the invention, the cyclic phenol sulfide represented by general formula (1) is added in an amount of preferably 0.01-1.0% by mass, more preferably 0.01-0.35% by mass, most preferably 0.01-0.20% by mass, based on the amount of the charge-transporting agents used which have an arylamino group in the molecule. When the amount of the cyclic phenol sulfide added is smaller than 0.01% by mass, there are cases where a sufficient durability-improving effect is not obtained. On the other hand, in case where the amount thereof exceeds 1.0% by mass, a higher durability-improving effect tends to be not obtained and such a large amount is disadvantageous from the standpoint of cost.

Advantages of the Invention

According to the invention, a charge-transporting agent having an arylamino group and a cyclic phenol sulfide are used in combination. Thereby, changes in charge potential and residual potential are little, and only a small amount of additives is required. Therefore, a photoreceptor for electrophotography can be provided which does not impair basic performances of electrophotography and has excellent stability to repeated use.

DESCRIPTION OF THE REFERENCE NUMERALS

Figure 1:
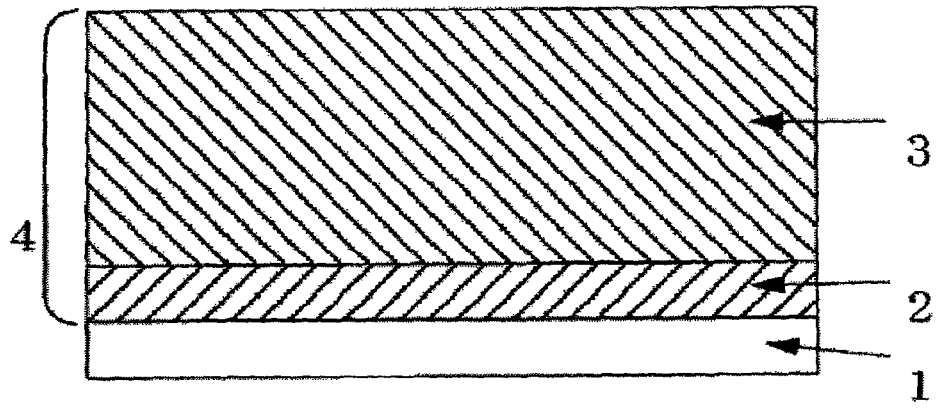
FIG. 1 is a diagrammatic sectional view illustrating the layer constitution of a function allocation type photoreceptor for electrophotography.

1: Conductive support
2: Charge-generating layer
3: Charge-transporting layer
4: Photosensitive layer
5: Undercoat layer
6: Layer containing charge-transporting substance
7: Charge-generating substance
8: Protective layer

BEST MODE FOR CARRYING OUT THE INVENTION

There are various forms of photosensitive layer. The photosensitive layer of the photoreceptor for electrophotography of the invention may have any of the forms. Photoreceptors employing typical examples of the various forms are shown in FIG. 1 to FIG. 7.

Figure 2:
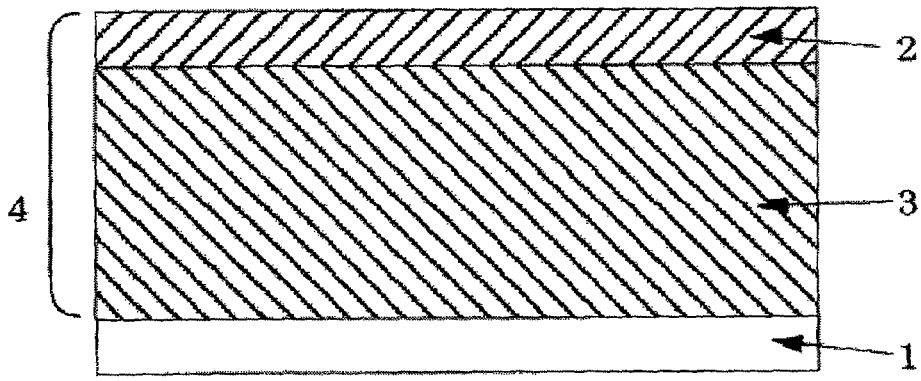
FIG. 2 is a diagrammatic sectional view illustrating the layer constitution of another function allocation type photoreceptor for electrophotography.
Figure 3:
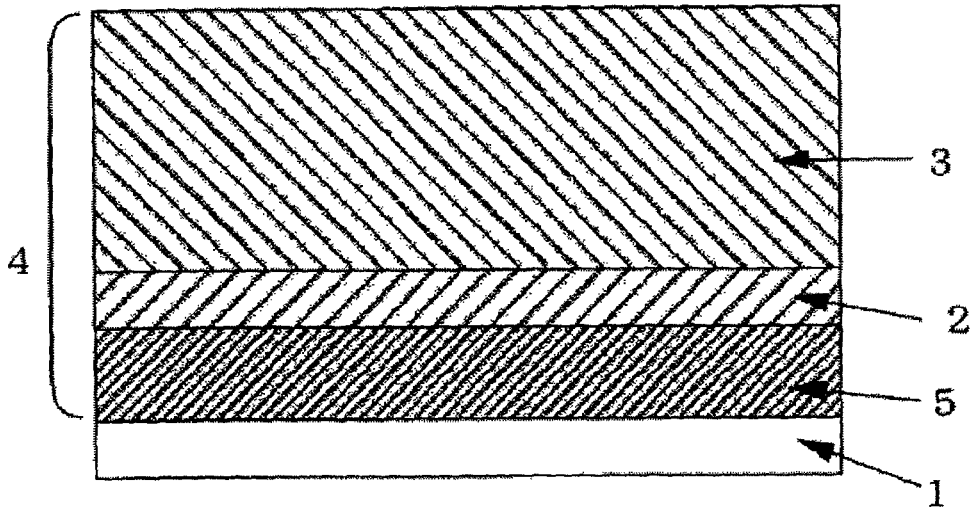
FIG. 3 is a diagrammatic sectional view illustrating the layer constitution of a function allocation type photoreceptor for electrophotography which has an undercoat layer formed between a charge-generating layer and a conductive support.
Figure 4:
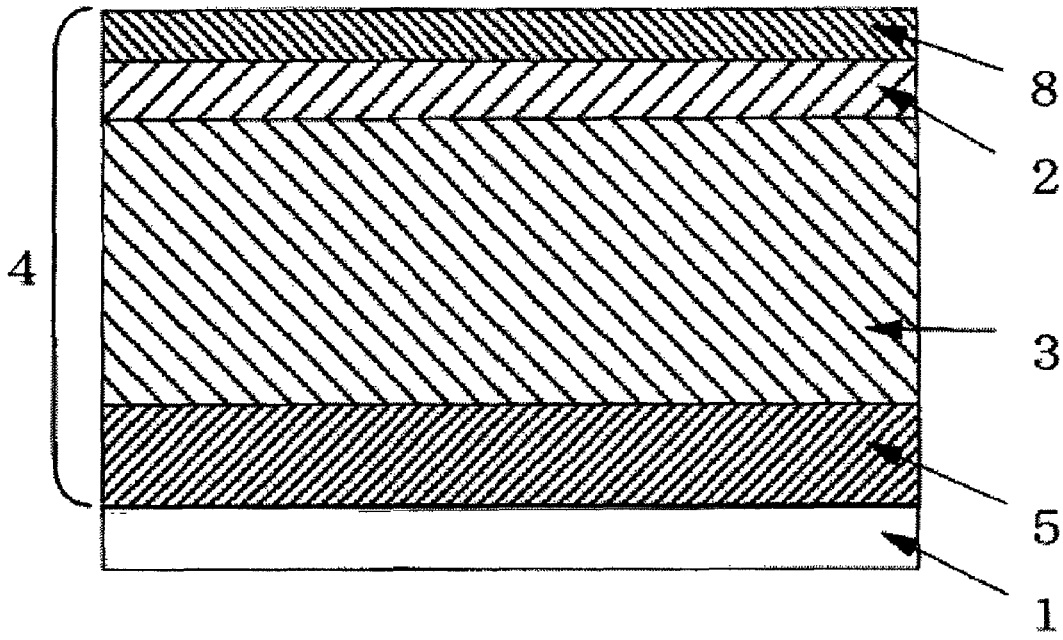
FIG. 4 is a diagrammatic sectional view illustrating the layer constitution of a function allocation type photoreceptor for electrophotography which has an undercoat layer formed between a charge-transporting layer and a conductive support and further has a protective layer formed on a charge-generating layer.
Figure 5:
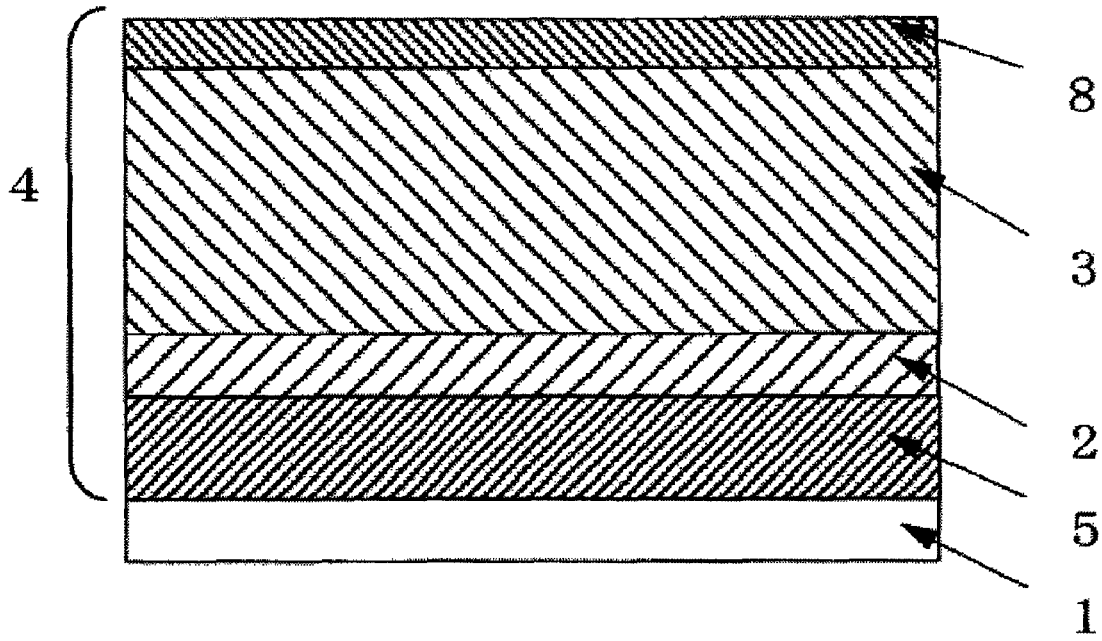
FIG. 5 is a diagrammatic sectional view illustrating the layer constitution of a function allocation type photoreceptor for electrophotography which has an undercoat layer formed between a charge-generating layer and a conductive support and further has a protective layer formed on a charge-transporting layer.
Figure 6:
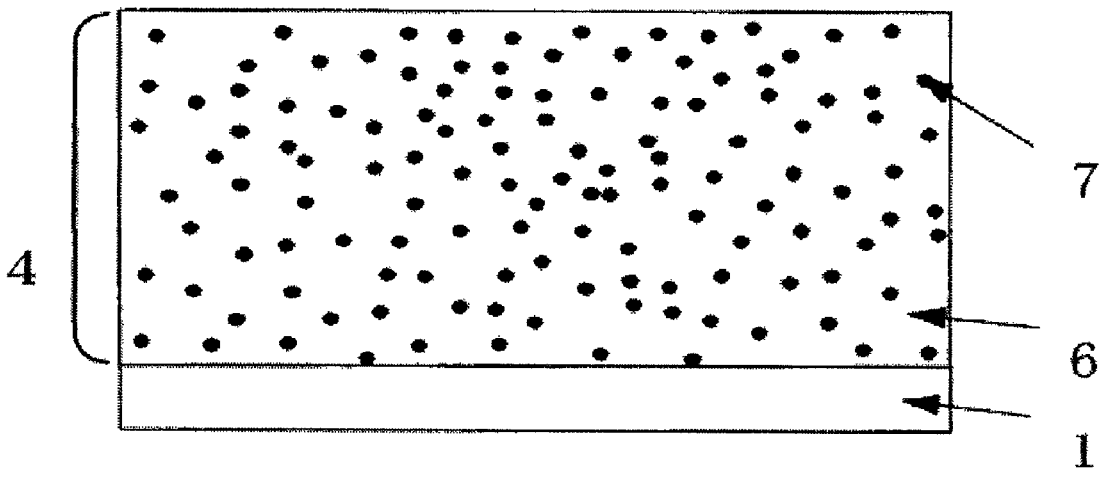
FIG. 6 is a diagrammatic sectional view illustrating the layer constitution of a single-layer type photoreceptor for electrophotography.
Figure 7:
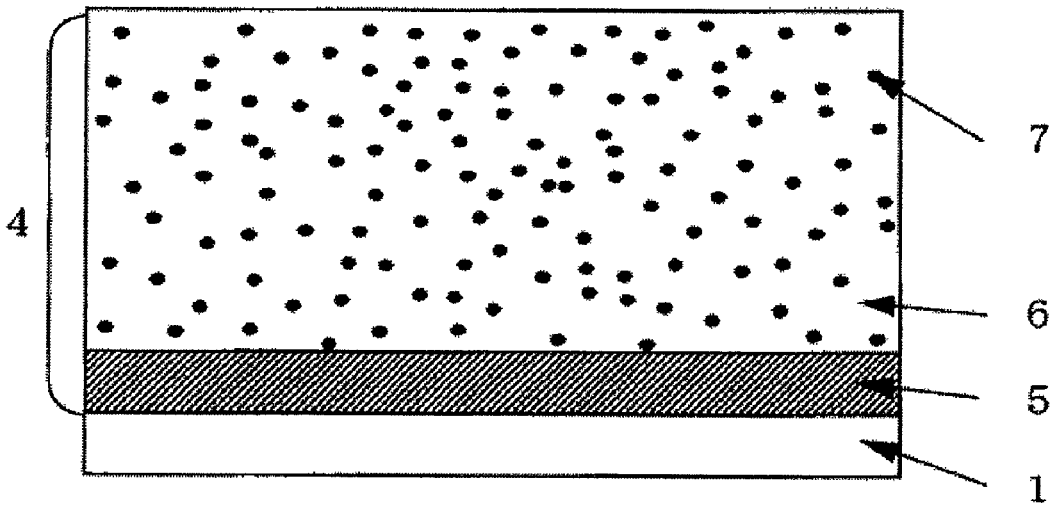
FIG. 7 is a diagrammatic sectional view illustrating the layer constitution of a single-layer type photoreceptor for electrophotography which has an undercoat layer formed between a photosensitive layer and a conductive support.

FIG. 1 and FIG. 2 show photoreceptors each constituted of a conductive support 1 and a photosensitive layer 4 formed thereon which has a multilayer structure composed of a charge-generating layer 2 containing a charge-generating substance as a main component and a charge-transporting layer 3 containing a charge-transporting substance and a binder resin as main components. In such constitutions, the photosensitive layer 4 may be formed via an undercoat layer 5 for charge regulation formed on the conductive support, as shown in FIG. 3, FIG. 4, and FIG. 5. A protective layer 8 may be formed as an outermost layer. Furthermore, in the invention, a photosensitive layer 4 constituted of a layer 6 which contains a charge-transporting substance and a binder resin as main components and further contains a charge-generating substance 7 dissolved or dispersed in the layer 6 may be formed directly or via an undercoat layer 5 over a conductive support 1 as shown in FIG. 6 and FIG. 7.

The photoreceptor of the invention can be produced by ordinary methods in the following manners. For example, a cyclic phenol sulfide represented by general formula (1) described above and one or more specific amine compounds represented by any of general formulae (2) to (7) are dissolved in an appropriate solvent together with a binder resin. According to need, a charge-generating substance, an electron-attracting compound, and other ingredients such as a plasticizer and a pigment are added to the solution to prepare a coating fluid. This coating fluid is applied to a conductive support and dried to form a photosensitive layer of several micrometers to tens of micrometers. Thus, a photoreceptor can be produced. In the case of a photosensitive layer composed of two layers, i.e., a charge-generating layer and a charge-transporting layer, a photoreceptor can be produced by a method in which a coating fluid prepared by dissolving a cyclic phenol sulfide represented by general formula (1) and one or more specific amine compounds represented by any of general formulae (2) to (7) in an appropriate solvent together with a binder resin and adding ingredients such as a plasticizer and a pigment to the resultant solution is applied to a charge-generating layer. Alternatively, a photoreceptor of that kind can be produced by applying that coating fluid to obtain a charge-transporting layer and forming a charge-generating layer thereon. According to need, an undercoat layer and a protective layer may be formed in the photoreceptors thus produced.

The hydrazone compounds represented by general formulae (2) to (4) to be used in the invention can be obtained according to production processes or synthesis examples which have been reported (see, for example, patent document 4). The styryl compounds represented by general formula (5) to be used in the invention can also be obtained according to production processes or synthesis examples which have been reported (see, for example, patent document 5). The benzidine compounds represented by general formula (6) to be used in the invention can be obtained according to production processes or synthesis examples which have been reported (see, for example, patent document 6). Furthermore, the p-terphenyl compounds represented by general formula (7) to be used in the invention can be obtained according to production processes or synthesis examples which have been reported (see, for example, patent document 6).

Patent Document 4: JP-A-9-202762
Patent Document 5: JP-A-8-211636
Patent Document 6: JP-A-7-126225

In the cyclic phenol sulfide represented by general formula (1) to be used in the invention, X in general formula (1) is a hydrogen atom, a hydrocarbon group, or an acyl group. The number of carbon atoms in the hydrocarbon is not particularly limited so long as it is 1 or larger. However, the number thereof is preferably 1-50, more preferably 1-20. Examples of such hydrocarbon groups include saturated aliphatic hydrocarbon groups, unsaturated aliphatic hydrocarbon groups, alicyclic hydrocarbon groups, alicyclic-aliphatic hydrocarbon groups, aromatic hydrocarbon groups, and aromatic-aliphatic hydrocarbon groups.

Examples of the saturated aliphatic hydrocarbon groups include alkyl groups such as methyl, ethyl, n-propyl, isopropyl, n-butyl, isobutyl, tert-butyl, n-pentyl, isopentyl, neopentyl, tert-pentyl, 2-methylbutyl, n-hexyl, isohexyl, 3-methylpentyl, ethylbutyl, n-heptyl, 2-methylhexyl, n-octyl, isooctyl, tert-octyl, 2-ethylhexyl, 3-methylheptyl, n-nonyl, isononyl, 1-methyloctyl, ethylheptyl, n-decyl, 1-methylnonyl, n-undecyl, 1,1-dimethylnonyl, n-dodecyl, n-tetradecyl, n-heptadecyl, and n-octadecyl.

Suitable examples of the unsaturated aliphatic hydrocarbon groups include alkenyl and alkynyl groups such as vinyl, allyl, isopropenyl, 2-butenyl, 2-methylallyl, 1,1-dimethylallyl, 3-methyl-2-butenyl, 3-methyl-3-butenyl, 4-pentenyl, hexenyl, octenyl, nonenyl, and decenyl.

Suitable examples of the alicyclic hydrocarbon groups include cycloalkyl, cycloalkenyl, and cycloalkynyl groups such as cyclopropyl, cyclobutyl, cyclopentyl, cyclohexyl, cycloheptyl, cyclooctyl, 3-methylcyclohexyl, 4-methylcyclohexyl, 4-ethylcyclohexyl, 2-methylcyclooctyl, cyclopropenyl, cyclobutenyl, cyclopentenyl, cyclohexenyl, cyclooctenyl, 4-methylcyclohexenyl, and 4-ethylcyclohexenyl.

Suitable examples of the alicyclic-aliphatic hydrocarbon groups include alkyl, alkenyl, and alkynyl groups substituted with a cycloalkyl, cycloalkenyl, or cycloalkynyl group or the like, such as cyclopropylethyl, cyclobutylethyl, cyclopentylethyl, cyclohexylmethyl, cyclohexylethyl, cycloheptylmethyl, cyclooctylethyl, 3-methylcyclohexylpropyl, 4-methylcyclohexylethyl, 4-ethylcyclohexylethyl, 2-methylcyclooctylethyl, cyclopropenylbutyl, cyclobutenylethyl, cyclopentenylethyl, cyclohexenylmethyl, cycloheptenylmethyl, cyclooctenylethyl, 4-methylcyclohexenylpropyl, and 4-ethylcyclohexenylpentyl.

Suitable examples of the aromatic hydrocarbon groups include aryl groups such as phenyl and naphthyl; and alkylaryl, alkenylaryl, and alkynylaryl groups such as 4-methylphenyl, 3,4-dimethylphenyl, 3,4,5-trimethylphenyl, 2-ethylphenyl, n-butylphenyl, tert-butylphenyl, amylphenyl, hexylphenyl, nonylphenyl, 2-tert-butyl-5-methylphenyl, cyclohexylphenyl, cresyl, hydroxyethylcresyl, 2-methoxy-4-tert-butylphenyl, and dodecylphenyl. The alkyl moiety of such an alkylaryl group, alkenyl moiety of such an alkenylaryl group, and alkynyl moiety of such an alkynylaryl group may have a cyclic structure.

Examples of the aromatic-aliphatic hydrocarbon groups include aralkyl, aralkenyl, and aralkynyl groups such as benzyl, 1-phenylethyl, 2-phenylethyl, 2-phenylpropyl, 3-phenylpropyl, 4-phenylbutyl, 5-phenylpentyl, 6-phenylhexyl, 1-(4-methylphenypethyl, 2-(4-methylphenyl)ethyl, 2-methylbenzyl, and 1,1-dimethyl-2-phenylethyl. The alkyl moiety of such an aralkyl group, alkenyl moiety of such an aralkenyl group, and alkynyl moiety of such an aralkynyl group may have a cyclic structure.

The number of carbon atoms in the acyl group is not particularly limited so long as it is 1 or larger. However, the number thereof is preferably 1-40, more preferably 1-20. The acyl group may have been substituted with any of those hydrocarbon groups. Suitable examples of the acyl group include formyl, acetyl, propionyl, butyryl, isobutyryl, valeryl, isovaleryl, oxalyl, succinyl, pivaloyl, stearoyl, benzoyl, phenylpropionyl, toluoyl, naphthoyl, phthaloyl, indanecarbonyl, p-methylbenzoyl, and cyclohexylcarbonyl.

Y in general formula (1) is a hydrogen atom, a hydrocarbon group, a halogenated hydrocarbon group, —COR1, —OR2, —COOR3, —CN, —$CONH_2$, —$NO_2$, —NR4R5, a halogen atom, —$SO_4$R6, or —$SO_3$R7. Examples of the hydrocarbon group and —COR1 group represented by Y include the same hydrocarbon groups and acyl groups as those enumerated above with regard to X, and preferred examples thereof also are the same. Examples of the halogenated hydrocarbon group include halogen-substituted forms of the same hydrocarbon groups as those enumerated above with regard to X, and preferred examples of the hydrocarbon group in the halogenated hydrocarbon group also are the same.

R1, R2, R3, R4, R5, R6, and R7 each are a hydrogen atom or a hydrocarbon group. Examples of this hydrocarbon group include the same hydrocarbons as those enumerated above with regard to X, and preferred examples thereof also are the same. This hydrocarbon group may have been substituted with a substituent such as —COR1, —OR2, —COOR3, —CN, —$CONH_2$, —$NO_2$, —NR4R5, a halogen atom, —$SO_4$R6, or —$SO_3$R7. The halogen atom may be any of fluorine, chlorine, bromine, and iodine atoms.

In general formula (1), four to twelve X's are present per molecule. These X's may be the same or different.

In general formula (1), four to twelve Y's are present per molecule. These Y's may be the same or different.

Furthermore, in general formula (1), four to twelve Z1's are present per molecule. These Z1's may be the same or different.

The cyclic phenol sulfide represented by general formula (1) to be used in the invention can be obtained according to production processes or synthesis examples which have been reported (see, for example, patent documents 7 and 8).

Patent Document 7: JP-A-9-227553

Patent Document 8: Domestic Re-publication of PCT Patent Application WO98/09959

Especially preferred examples of the cyclic phenol sulfide represented by general formula (1) to be used in the invention, which can be obtained by such processes, are shown below. However, the cyclic phenol sulfide to be used in the invention should not be construed as being limited to the following examples.

[Chem. 8]

Cyclic Phenol Sulfide No. 1

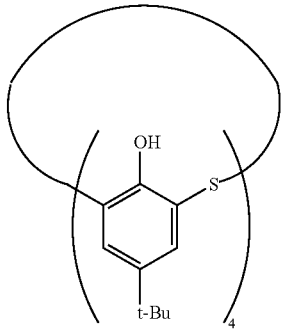

[Chem. 9]

Cyclic Phenol Sulfide No. 2

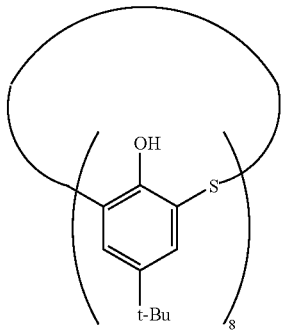

[Chem. 10]

Cyclic Phenol Sulfide No. 3

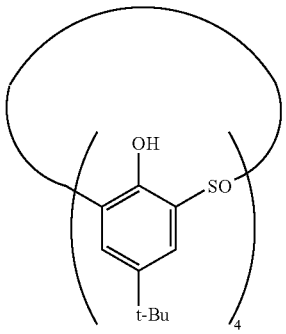

[Chem. 11]

Cyclic Phenol Sulfide No. 4

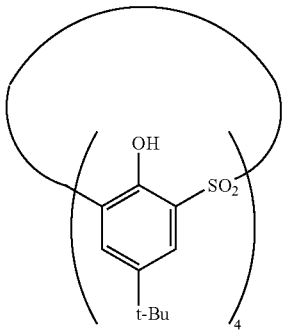

As the conductive support on which the photosensitive layer according to the invention is to be formed, materials used in known photoreceptors for electrophotography can be employed. Examples thereof include a drum or sheet of a metal such as aluminum, aluminum alloy, stainless steel, copper, zinc, vanadium, molybdenum, chromium, titanium, nickel, indium, gold, or platinum, a laminate of any of these metals, a support having a vapor-deposited coating of any of these metals, a plastic film, plastic drum, paper, or paper tube which has undergone a conductivity-imparting treatment including applying a conductive substance, such as a metal powder, carbon black, copper iodide, or polymeric electrolyte, together with an appropriate binder, and a plastic film or plastic drum to which conductivity has been imparted by incorporating a conductive substance thereinto.

An undercoat layer containing a resin or containing a resin and a pigment may be formed between the conductive support and the photosensitive layer according to need. The pigment to be dispersed in the undercoat layer may be a powder in general use. However, a white or nearly white pigment which shows almost no absorption in a near infrared region is desirable when sensitivity enhancement is taken into account. Examples of such pigments include metal oxides represented by titanium oxide, zinc oxide, tin oxide, indium oxide, zirconium oxide, alumina, and silica. Ones which have no hygroscopicity and fluctuate little with environment are desirable.

The resin to be used for forming the undercoat layer desirably is a resin having high resistance to general organic solvents because a photosensitive layer is to be formed on the undercoat layer by coating fluid application using a solvent. Examples of such resins include water-soluble resins such as poly(vinyl alcohol), casein, and poly(sodium acrylate), alcohol-soluble resins such as copolymer nylons and methoxymethylated nylons, and curable resins forming a three-dimensional network structure, such as polyurethanes, melamine resins, and epoxy resins.

The charge-generating layer in the invention is constituted of, for example, a charge-generating agent, a binder resin, and additives which are added according to need. Examples of processes for forming the layer include a method based on coating fluid application, vapor deposition, and CVD.

Examples of the charge-generating agent include phthalocyanine pigments such as titanylphthalocyanine oxide of various crystal forms, titanylphthalocyanine oxide giving a Cu-Kα X-ray diffraction spectrum having an intense peak at diffraction angles 2θ±0.2° of 9.3, 10.6, 13.2, 15.1, 20.8, 23.3, and 26.3, titanylphthalocyanine oxide having an intense peak at diffraction angles 2θ±0.2° of 7.5, 10.3, 12.6, 22.5, 24.3, 25.4, and 28.6, titanylphthalocyanine oxide having an intense peak at diffraction angles 2θ±0.2° of 9.6, 24.1, and 27.2, metal-free phthalocyanines of various crystal forms including τ-form and X-form, copper phthalocyanine, aluminum phthalocyanine, zinc phthalocyanine, α-form, β-form, and Y-form oxotitanylphthalocyanines, cobalt phthalocyanine, hydroxygallium phthalocyanine, chloroaluminum phthalocyanine, and chloroindium phthalocyanine; azo pigments such as azo pigments having a triphenylamine framework (see, for example, patent document 9), azo pigments having a carbazole framework (see, for example, patent document 10), azo pigments having a fluorene framework (see, for example, patent document 11), azo pigments having an oxadiazole framework (see, for example, patent document 12), azo pigments having a bisstilbene framework (see, for example, patent document 13), azo pigments having a dibenzothiophene framework (see, for example, patent document 14), azo pigments having a distyrylbenzene framework (see, for example, patent document 15), azo pigments having a distyrylcarbazole framework (see, for example, patent document 16), azo pigments having a distyryloxadiazole framework (see, for example, patent document 17), azo pigments having a stilbene framework (see, for example, patent document 18), trisazo pigments having a carbazole framework (see, for example, patent documents 19 and 20), azo pigments having an anthraquinone framework (see, for example, patent document 21), and bisazo pigments having a diphenylpolyene framework (see, for example, patent documents 22 to 26); perylene pigments such as perylenic acid anhydride and perylenic acid imide; polycyclic quinone pigments such as anthraquinone derivatives, anthanthrone derivatives, dibenzpyrenequinone derivatives, pyranthrone derivatives, violanthrone derivatives, and isoviolanthrone derivatives; diphenylmethane and triphenylmethane pigments; cyanine and azomethine pigments; and indigoid pigments, bisbenzimidazole pigments, azulenium salts, pyrylium salts, thiapyrylium salts, benzopyrylium salts, and squarylium salts. These may be used alone or as a mixture of two or more thereof according to need.

Patent Document 9: JP-A-53-132347
Patent Document 10: JP-A-53-095033
Patent Document 11: JP-A-54-022834
Patent Document 12: JP-A-54-012742
Patent Document 13: JP-A-54-017733
Patent Document 14: JP-A-54-021728
Patent Document 15: JP-A-53-133445
Patent Document 16: JP-A-54-017734
Patent Document 17: JP-A-54-002129
Patent Document 18: JP-A-53-138229
Patent Document 19: JP-A-57-195767
Patent Document 20: JP-A-57-195768
Patent Document 21: JP-A-57-202545
Patent Document 22: JP-A-59-129857
Patent Document 23: JP-A-62-267363
Patent Document 24: JP-A-64-079753
Patent Document 25: JP-B-3-034503
Patent Document 26: JP-B-4-052459

The binder resin to be used in the charge-generating layer is not particularly limited. Examples thereof include polycarbonates, polyarylates, polyesters, polyamides, polyethylene, polystyrene, polyacrylates, polymethacrylates, poly(vinyl butyral), poly(vinyl acetal), poly(vinyl formal), poly(vinyl alcohol), polyacrylonitrile, polyacrylamide, styrene/acrylic copolymers, styrene/maleic anhydride copolymers, acrylonitrile/butadiene copolymers, polysulfones, polyethersulfones, silicone resins, and phenoxy resins. These may be used alone or as a mixture of two or more thereof according to need.

Examples of the additives which are used according to need include antioxidants, ultraviolet absorbers, light stabilizers, dispersants, adhesives, and sensitizers. The charge-generating layer produced from the materials described above may have a thickness of 0.1-2.0 μm, preferably 0.1-1.0 μm.

The charge-transporting layer in the invention can be formed, for example, by dissolving the charge-transporting agent, a cyclic phenol sulfide represented by general formula (1), and a binder resin in a solvent optionally together with an electron-accepting substance and additives, applying the resultant coating fluid to the charge-generating layer or to the conductive support or undercoat layer, and then drying the coating fluid applied.

Examples of the binder resin to be used for the charge-transporting layer include various resins compatible with the charge-transporting agent and additives, such as polymers and copolymers of vinyl compounds, e.g., styrene, vinyl acetate, vinyl chloride, acrylic esters, methacrylic esters, and butadiene, poly(vinyl acetal), polycarbonates (see, for example, patent documents 27 to 30), polyesters, poly(phenylene oxide), polyurethane, cellulose esters, phenoxy resins, silicone resins, and epoxy resins. These may be used alone or as a mixture of two or more thereof according to need. The amount of the binder resin to be used is generally in the range of 0.4-10 times by mass, preferably 0.5-5 times by mass, the amount of the charge-transporting agent. Specific examples of especially effective resins include polycarbonate resins such as "Yupilon Z" (manufactured by Mitsubishi Engineering-Plastic Corp.) and "Bisphenol A/Biphenol Copolycarbonate" (manufactured by Idemitsu Kosan Co., Ltd.).

Patent Document 27: JP-A-60-172044

Patent Document 28: JP-A-62-247374

Patent Document 29: JP-A-63-148263

Patent Document 30: JP-A-2-254459

The solvent to be used for forming the charge-transporting layer is not particularly limited so long as the charge-transporting agent, binder resin, electron-accepting substance, and additives are soluble therein. Examples of usable solvents include polar organic solvents such as tetrahydrofuran, 1,4-dioxane, methyl ethyl ketone, cyclohexanone, acetonitrile, N,N-dimethylformamide, and ethyl acetate, aromatic organic solvents such as toluene, xylene, and chlorobenzene, and chlorinated hydrocarbon solvents such as chloroform, trichloroethylene, dichloromethane, 1,2-dichloroethane, and carbon tetrachloride. These may be used alone or as a mixture of two or more thereof according to need.

An electron-accepting substance can be incorporated into the photosensitive layer in the invention for the purpose of improving sensitivity, reducing residual potential, or diminishing fatigue in repeated use. Examples of the electron-accepting substance include succinic anhydride, maleic anhydride, dibromosuccinic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinone chlorimide, chloranil, bromanil, dichlorodicyano-p-benzoquinone, anthraquinone, dinitroanthraquinone, 2,3-dichloro-1,4-naphthoquinone, 1-nitroanthraquinone, 2-chloroanthraquinone, phenanthrenequinone, terephthalalmalenonitrile, 9-anthrylmethylidenemalenonitrile, 9-fluorenylidenemalenonitrile, polynitro-9-fluorenylidenemalenonitrile, 4-nitrobenzaldehyde, 9-benzoylanthracene, indanedione, 3,5-dinitrobenzophenone, 4-chloronaphthalic anhydride, 3-benzalphthalide, 3-(α-cyano-p-nitrobenzal)-4,5,6,7-tetrachlorophthalide, picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, and other compounds having a high electron affinity.

A surface-protective layer may be formed on the surface of the photoreceptor according to need. Examples of the material for the protective layer include a resin such as a polyester, polyamide, or the like and a mixture of such a resin with a substance capable of regulating electrical resistance, such as a metal or a metal oxide. It is desirable that this surface-protective layer should be as transparent as possible in a wavelength region in which the charge-generating agent shows light absorption.

The invention will be illustrated in greater detail by reference to the following Examples, but the invention should not be construed as being limited thereto. In the Examples, the "parts" are by mass and the concentrations are given in terms of % by mass.

Example 1

In 13 parts of methanol was dissolved 1 part of an alcohol-soluble polyamide (Amilan CM-4000, manufactured by Toray Industries, Inc.). Thereto was added 5 parts of titanium oxide (Tipaque CR-EL, manufactured by Ishihara Sangyo Kaisha, Ltd.). The resultant mixture was treated with a paint shaker for 8 hours to disperse the titanium oxide and thereby produce a coating fluid for undercoat layer formation. Thereafter, the coating fluid was applied with a wire-wound bar to the aluminum side of a PET film having a vapor-deposited aluminum coating, and then dried to form an undercoat layer having a thickness of 1 μm.

Subsequently, 1.5 parts of titanylphthalocyanine oxide having a Cu-Kα X-ray diffraction spectrum having an intense peak at diffraction angles 2θ±0.2° of 7.5, 10.3, 12.6, 22.5, 24.3, 25.4, and 28.6 (charge-generating agent No. 1)

[Chem. 12]

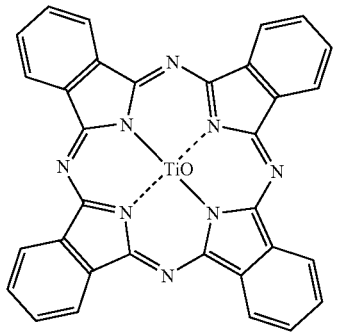

was added to 50 parts of a 3% cyclohexanone solution of a poly(vinyl butyral) resin (S-LEC BL-S, manufactured by Sekisui Chemical Co., Ltd.). The resultant mixture was treated with an ultrasonic disperser for 1 hour to disperse the charge-generating agent. The dispersion obtained was applied to the undercoat layer with a wire-wound bar and then dried at 110° C. and ordinary pressure for 1 hour to form a charge-generating layer having a thickness of 0.6 μm.

On the other hand, 0.1 part of cyclic phenol sulfide p-tert-butylthiacalix[4]arene (cyclic phenol sulfide No. 1) and 100 parts of the following benzidine compound as a charge-transporting agent (charge-transporting agent No. 1)

[Chem. 13]

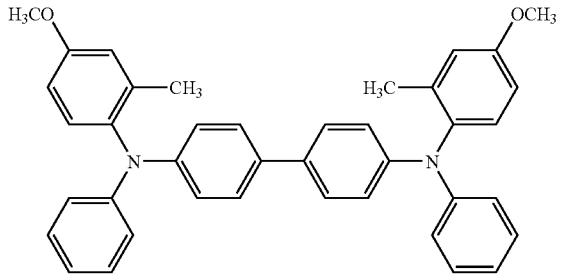

were added to 962 parts of a 13.0% tetrahydrofuran solution of a polycarbonate resin (Yupilon Z, manufactured by Mitsubishi Engineering-Plastic Corp.). The additive and charge-transporting agent were completely dissolved by propagating an ultrasonic wave thereto. This solution was applied to the charge-generating layer with a wire-wound bar and dried at 110° C. and ordinary pressure for 30 minutes to form a charge-transporting layer having a thickness of 20 μm. Thus, a photoreceptor was produced.

Comparative Example 1

The same procedure as in Example 1 was conducted, except that the cyclic phenol sulfide p-tert-butylthiacalix[4]arene was omitted. Thus, a comparative photoreceptor was produced.

Comparative Example 2

The same procedure as in Example 1 was conducted, except that p-tert-butylcalix[4]arene, which is not a sulfide, was used in place of the cyclic phenol sulfide p-tert-butylthiacalix[4]arene. Thus, a comparative photoreceptor was produced.

Comparative Example 3

The same procedure as in Example 1 was conducted, except that p-tert-butylcalix[8]arene, which is not a sulfide, was used in place of the cyclic phenol sulfide p-tert-butylthiacalix[4]arene. Thus, a comparative photoreceptor was produced.

Example 2

A photoreceptor was produced in the same manner as in Example 1, except that titanylphthalocyanine oxide giving a Cu-Kα X-ray diffraction spectrum having an intense peak at diffraction angles 2θ±0.2° of 9.6, 24.1, and 27.2 (charge-generating agent No. 2) was used in place of the charge-generating agent No. 1 and that the following p-terphenyl compound (charge-transporting agent No. 2)

[Chem. 14]

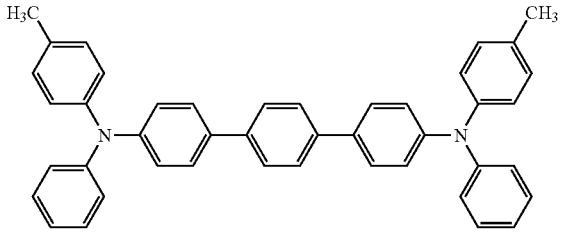

was used as a charge-transporting agent in place of the benzidine compound (charge-transporting agent No. 1).

Comparative Example 4

The same procedure as in Example 2 was conducted, except that the cyclic phenol sulfide p-tert-butylthiacalix[4]arene was omitted. Thus, a comparative photoreceptor was produced.

Comparative Example 5

The same procedure as in Example 2 was conducted, except that p-tert-butylcalix[4]arene, which is not a sulfide, was used in place of the cyclic phenol sulfide p-tert-butylthiacalix[4]arene. Thus, a comparative photoreceptor was produced.

Example 3

Ten parts of an alcohol-soluble polyamide (Amilan CM-8000, manufactured by Toray Industries, Inc.) was dissolved in 190 parts of methanol. The resultant solution was applied with a wire-wound bar to the aluminum side of a PET film having a vapor-deposited aluminum coating, and then dried to form an undercoat layer having a thickness of 1 μm.

Subsequently, 1.5 parts of the following r-form metal-free phthalocyanine as a charge-generating agent (charge-generating agent No. 3)

[Chem. 15]

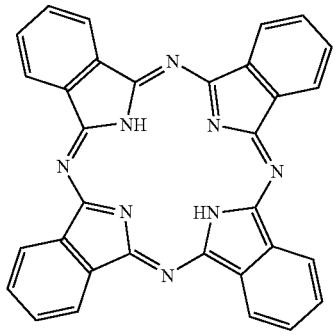

was added to 50 parts of a 3% cyclohexanone solution of a poly(vinyl butyral) resin (S-LEC BL-S, manufactured by Sekisui Chemical Co., Ltd.). The resultant mixture was treated with an ultrasonic disperser for 1 hour to disperse the charge-generating agent. The dispersion obtained was applied to the undercoat layer with a wire-wound bar and then dried at 110° C. and ordinary pressure for 1 hour to form a charge-generating layer having a thickness of 0.6 μm.

On the other hand, 0.1 part of cyclic phenol sulfide p-tert-butylthiacalix[8]arene (cyclic phenol sulfide No. 2) as an additive and 100 parts of the following hydrazone compound as a charge-transporting agent (charge-transporting agent No. 3)

[Chem. 16]

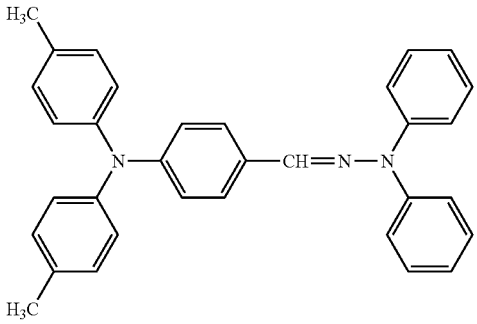

were added to 962 parts of a 13.0% tetrahydrofuran solution of a polycarbonate resin (Yupilon Z, manufactured by Mitsubishi Engineering-Plastic Corp.). The additive and charge-transporting agent were completely dissolved by propagating an ultrasonic wave thereto. This solution was applied to the charge-generating layer with a wire-wound bar and dried at 110° C. and ordinary pressure for 30 minutes to form a charge-transporting layer having a thickness of 20 μm. Thus, a photoreceptor was produced.

Comparative Example 6

The same procedure as in Example 3 was conducted, except that the cyclic phenol sulfide p-tert-butylthiacalix[8]arene was omitted. Thus, a comparative photoreceptor was produced.

Comparative Example 7

The same procedure as in Example 3 was conducted, except that p-tert-butylcalix[8]arene, which is not a sulfide, was used in place of the cyclic phenol sulfide p-tert-butylthiacalix[8]arene. Thus, a comparative photoreceptor was produced.

Example 4

A photoreceptor was produced in the same manner as in Example 2, except that a 2:1 by mass mixture of the following styryl compound (charge-transporting agent No. 4)

[Chem. 17]

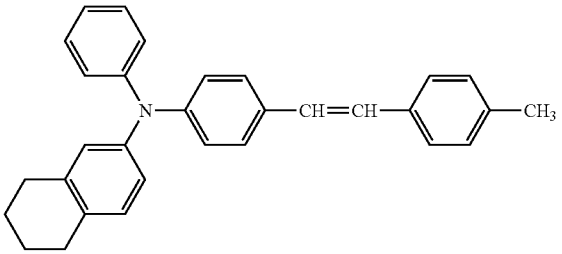

and the following styryl compound (charge-transporting agent No. 5)

[Chem. 18]

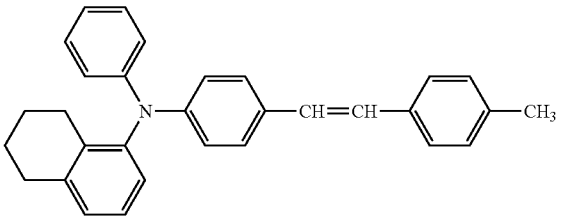

was used in place of the charge-transporting agent No. 2 and that cyclic phenol sulfide p-tert-butylsulfonylcalix[4]arene (cyclic phenol sulfide No. 4) was used in place of the cyclic phenol sulfide p-tert-butylthiacalix[4]arene.

Comparative Example 8

The same procedure as in Example 4 was conducted, except that the cyclic phenol sulfide p-tert-butylsulfonylcalix[4]arene was omitted. Thus, a comparative photoreceptor was produced.

Comparative Example 9

The same procedure as in Example 4 was conducted, except that p-tert-butylcalix[4]arene, which is not a sulfide, was used in place of the cyclic phenol sulfide p-tert-butylsulfonylcalix[4]arene. Thus, a comparative photoreceptor was produced.

Example 5

The photoreceptors produced in Examples 1 to 4 and Comparative Examples 1 to 9 were evaluated for electrophotographic characteristics with a photoreceptor drum characteristics measuring apparatus (trade name "ELYSIA-II" manufactured by TREK Japan K.K.). First, each photoreceptor was subjected to −5.5 kV corona discharge in the dark and subsequently illuminated with an erase lamp at 70 1×, and the resultant charge potential V0 was measured. Subsequently, this photoreceptor was subjected to imaging exposure to 780-nm monochromic light at 30 μW, and the residual potential Vr was determined. The charging and exposure were subsequently repeated 1,000 times, and this photoreceptor was then examined for charge potential V0 and residual potential Vr. The results obtained are shown in Table 1.

TABLE 1

| Example and Comparative Example | Charge-generating agent No. | Charge-transporting agent No. | Cyclic phenol sulfide No. | Charge potential V0 (−V) | | Residual potential Vr (−V) | |
|---|---|---|---|---|---|---|---|
| | | | | Initial | 1000-time repetitions | Initial | 1000-time repetitions |
| Example 1 | 1 | 1 | 1 | 626 | 619 | 17 | 17 |
| Comp. Ex. 1 | 1 | 1 | — | 623 | 622 | 25 | 26 |
| Comp. Ex. 2 | 1 | 1 | *A | 625 | 619 | 24 | 25 |
| Comp. Ex. 3 | 1 | 1 | *B | 618 | 615 | 26 | 28 |
| Example 2 | 2 | 2 | 1 | 660 | 663 | 26 | 27 |
| Comp. Ex. 4 | 2 | 2 | — | 662 | 661 | 36 | 37 |
| Comp. Ex. 5 | 2 | 2 | *A | 663 | 667 | 36 | 39 |
| Example 3 | 3 | 3 | 2 | 660 | 664 | 16 | 19 |
| Comp. Ex. 6 | 3 | 3 | — | 658 | 667 | 24 | 40 |
| Comp. Ex. 7 | 3 | 3 | *B | 664 | 670 | 24 | 38 |
| Example 4 | 2 | 4, 5 | 4 | 660 | 668 | 21 | 22 |
| Comp. Ex. 8 | 2 | 4, 5 | — | 662 | 669 | 36 | 38 |
| Comp. Ex. 9 | 2 | 4, 5 | *A | 661 | 665 | 35 | 40 |

*A: p-tert-butylcalix[4]arene [corresponding to general formula (1) wherein X = H, Y = t-Bu, Z = CH2, and n = 4, although this compound is not a sulfide]
*B: p-tert-butylcalix[8]arene [corresponding to general formula (1) wherein X = H, Y = t-Bu, Z = CH2, and n = 8, although this compound is not a sulfide]

Example 6

To 83 parts of a cyclohexanone were added 1.0 part of the following bisazo pigment as a charge-generating agent (charge-generating agent No. 4)

[Chem. 19]

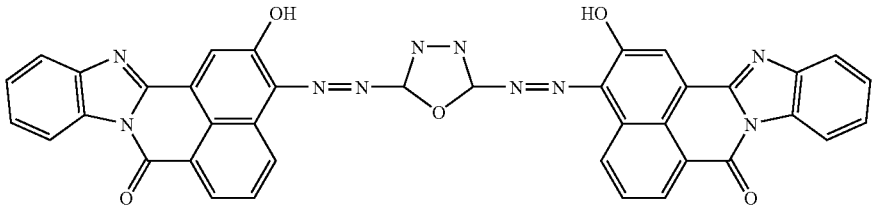

and 8.6 parts of a 5% cyclohexanone solution of a poly(vinyl butyral) resin (S-LEC BL-S, manufactured by Sekisui Chemical Co., Ltd.). The resultant mixture was subjected to a pulverization/dispersion treatment with a ball mill for 48 hours. The dispersion obtained was applied with a wire-wound bar to the aluminum side of a PET film having a vapor-deposited aluminum coating as a conductive support, and then dried to form a charge-generating layer having a thickness of 0.8 μm.

On the other hand, 0.01 part of cyclic phenol sulfide p-tert-butylsulfinylcalix[4]arene (cyclic phenol sulfide No. 3) and 100 parts of a 9:1 by mass mixture of the following styryl compound as a charge-transporting agent (charge-transporting agent No. 6)

[Chem. 20]

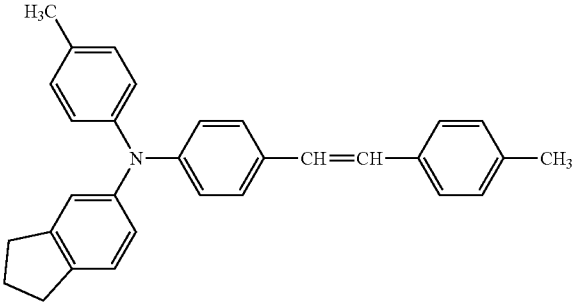

and the following styryl compound as another charge-transporting agent (charge-transporting agent No. 7)

[Chem. 21]

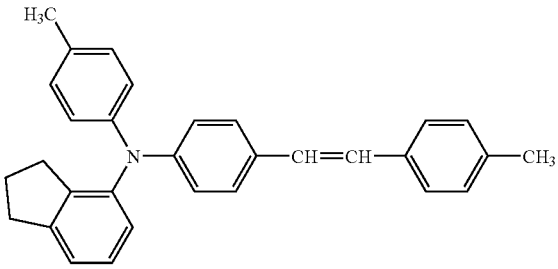

were added to 962 parts of a 13.0% tetrahydrofuran solution of a polycarbonate resin (Yupilon Z, manufactured by Mitsubishi Engineering-Plastic Corp.). The additive and the charge-transporting agents were completely dissolved by propagating an ultrasonic wave thereto. This solution was applied to the charge-generating layer with a wire-wound bar and dried at 110° C. and ordinary pressure for 30 minutes to form a charge-transporting layer having a thickness of 20 μm. Thus, a photoreceptor was produced.

Comparative Example 10

The same procedure as in Example 6 was conducted, except that the cyclic phenol sulfide p-tert-butylsulfinylcalix[4]arene was omitted. Thus, a comparative photoreceptor was produced.

Example 7

The photoreceptors produced in Example 6 and Comparative Example 10 were evaluated for electrophotographic characteristics with a photoreceptor drum characteristics measuring apparatus (trade name "ELYSIA-II" manufactured by TREK Japan K.K.). First, each photoreceptor was subjected to −5.0 kV corona discharge in the dark and subsequently illuminated with an erase lamp at 70 1×, and the resultant charge potential V0 was measured. Subsequently, this photoreceptor was subjected to imaging exposure to white light at 40 1×, and the residual potential Vr was determined.

The charging and exposure were subsequently repeated 1,000 times, and this photoreceptor was then examined for charge potential V0 and residual potential Vr. The results obtained are shown in Table 2.

TABLE 2

| Example and Comparative Example | Charge generating agent No. | Charge-transporting agent No. | Cyclic phenol sulfide No. | Charge potential V0 (−V) Initial | Charge potential V0 (−V) 1000-time repetitions | Residual potential Vr (−V) Initial | Residual potential Vr (−V) 1000-time repetitions |
|---|---|---|---|---|---|---|---|
| Example 6 | 4 | 6, 7 | 3 | 696 | 700 | 6 | 8 |
| Comp. Ex. 10 | 4 | 6, 7 | — | 692 | 695 | 9 | 13 |

It can be seen from the results of the Examples and Comparative Examples given above that a photoreceptor for electrophotography which changes little in charge potential and residual potential and has excellent durability can be provided by using one or more charge-transporting agents having an arylamino group in the molecule in combination with the cyclic phenol sulfide according to the invention.

While the invention has been described in detail and with reference to specific embodiments thereof, it will be apparent to one skilled in the art that various changes and modifications can be made therein without departing from the spirit and scope thereof.

This application is based on a Japanese patent application filed on Jan. 25, 2007 (Application No. 2007-014848), the contents thereof being herein incorporated by reference.

INDUSTRIAL APPLICABILITY

The photoreceptor for electrophotography obtained by the invention has a low residual potential even in an initial stage, changes little in electrophotographic characteristics, and is useful as an electrophotographic photoreceptor capable of realizing high durability.

The invention claimed is:

1. A photoreceptor for electrophotography, which comprises a conductive support and a photosensitive layer formed on the support, the photosensitive layer containing a compound represented by the following general formula (1):

(1)

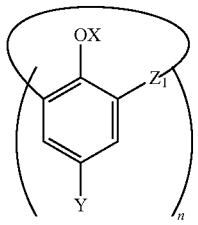

wherein X is a hydrogen atom, a hydrocarbon group, or an acyl group; Y is a hydrogen atom, a hydrocarbon group, a halogenated hydrocarbon group, —$COR_1$, —$OR_2$, —$COOR_3$, —CN, —$CONH_2$, —$NO_2$, —$NR_4R_5$, a halogen atom, —$SO_4R_6$, or —$SO_3R_7$, wherein $R_1$, $R_2$, $R_3$, $R_4$, $R_5$, $R_6$, and $R_7$ each are a hydrogen atom or a hydrocarbon group; $Z_1$ is a substituent selected from S, a sulfinyl group, and a sulfonyl group; n is an integer of 4-12; and the plural X's, the plural Y's, and the plural $Z_1$'s each may be the same or different, and one or more charge-transporting agents each having an arylamino group in the molecule.

2. The photoreceptor for electrophotography according to claim 1, wherein the charge-transporting agents having an arylamino group in the molecule are one or more hydrazone compounds represented by the following general formula (2), (3), or (4):

(2)

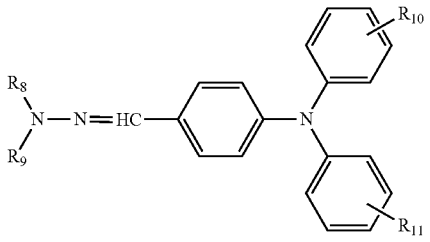

wherein $R_8$ and $R_9$ may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; and $R_{10}$ and $R_{11}$ may be the same or different and each represent a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; provided that when $R_8$ to $R_{11}$ further have a substituent, then the substituent may be a halogen atom, alkoxy group, aryloxy group, dialkylamino group, or alkylthio group, and that $R_8$ or $R_9$ may further have an alkyl group only when it $R_8$ or $R_9$ is an aryl group;

(3)

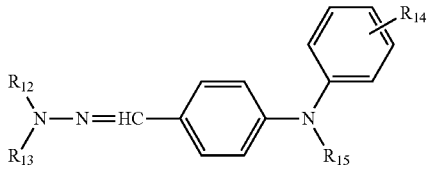

wherein $R_{12}$ and $R_{13}$ may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; $R_{14}$ represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and $R_{15}$ represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when $R_{12}$ to $R_{15}$ further have a substituent, then the substituent may be a halogen atom, alkoxy group, aryloxy group, dialkylamino group, or alkylthio group, and that $R_{12}$ or $R_{13}$ may further have an alkyl group only when it $R_{12}$ or $R_{13}$ is an aryl group;

(4)

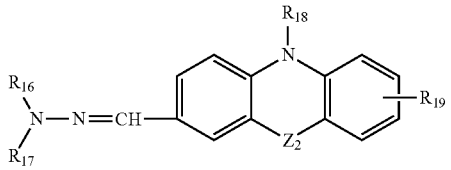

wherein $Z_2$ represents O, S, or a divalent group represented by $N(R_{18})$; $R_{16}$ and $R_{17}$ may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; $R_{19}$ represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and $R_{18}$ represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when $R_{16}$ to $R_{19}$ further have a substituent, then the substituent may be a halogen atom, alkoxy group, aryloxy group, dialkylamino group, or alkylthio group, and that $R_{16}$ or $R_{17}$ may further have an alkyl group only when $R_{16}$ or $R_{17}$ is an aryl group.

3. The photoreceptor for electrophotography according to claim 2, wherein the cyclic phenol sulfide represented by general formula (1) is contained in an amount of 0.01-1.0% by mass based on the amount of the charge-transporting agents used which have an arylamino group in the molecule.

4. The photoreceptor for electrophotography according to claim 1, wherein the charge-transporting agents having an arylamino group in the molecule are one or more styryl compounds represented by the following general formula (5):

(5)

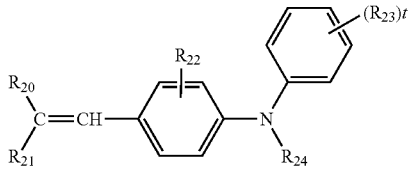

wherein $R_{20}$ and $R_{21}$ may be the same or different and each represent a substituted or unsubstituted phenyl group, a substituted or unsubstituted naphthyl group, a substituted or unsubstituted anthryl group, a substituted or unsubstituted fluorenyl group, or a substituted or unsubstituted heterocyclic group, the substituents being any of an alkyl group, alkoxy group, halogen atom, hydroxyl group, and phenyl group, each of which may be further substituted; $R_{22}$ represents hydrogen, a halogen atom, an alkyl group having 1-8 carbon atoms, an alkoxy group having 1-8 carbon atoms, or a mono- or dialkylamino group; $R_{23}$ represents a hydrogen atom, an alkyl group having 1-8 carbon atoms, an alkoxy group having 1-8 carbon atoms, a halogen atom, or a mono- or di-substituted amino group; t represents the number of $R_{23}$ groups and is an integer of 1 or 2; when t=2, then the two $R_{23}$ groups may be the same or different and the two $R_{23}$ groups may be bonded to each other to form a tetramethylene ring or trimethylene ring; and $R_{24}$ represents a substituted or unsubstituted phenyl group, the substituent being any of an alkyl group, alkoxy group, halogen atom, hydroxyl group, and substituted or unsubstituted phenyl group, each of which may be further substituted).

5. The photoreceptor for electrophotography according to claim 4, wherein the cyclic phenol sulfide represented by general formula (1) is contained in an amount of 0.01-1.0% by mass based on the amount of the charge-transporting agents used which have an arylamino group in the molecule.

6. The photoreceptor for electrophotography according to claim 1, wherein the charge-transporting agents having an arylamino group in the molecule are one or more benzidine compounds represented by the following general formula (6):

(6)

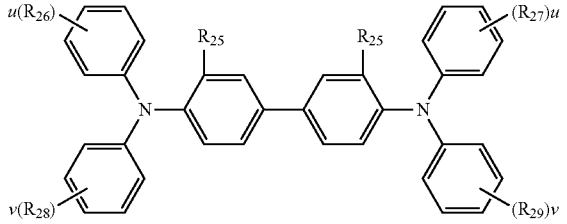

wherein $R_{25}$ represents a hydrogen atom, an alkyl group having 1-8 carbon atoms, an alkoxy group having 1-8 carbon atoms, or a halogen atom; $R_{26}$, $R_{27}$, $R_{28}$, and $R_{29}$ may be the same or different and each represent a hydrogen atom, an alkyl group having 1-8 carbon atoms, an alkoxy group having 1-8 carbon atoms, a halogen atom, or a mono- or di-substituted amino group; u represents the number of $R_{26}$ or $R_{27}$ groups and is an integer of 1 or 2; when u=2, then the two substituents bonded to the same phenyl group may be the same or different; v represents the number of $R_{28}$ or $R_{29}$ groups and is an integer of 1 or 2; and when v=2, then the two substituents bonded to the same phenyl group may be the same or different).

7. The photoreceptor for electrophotography according to claim 6, wherein the cyclic phenol sulfide represented by general formula (1) is contained in an amount of 0.01-1.0% by mass based on the amount of the charge-transporting agents used which have an arylamino group in the molecule.

8. The photoreceptor for electrophotography according to claim 1, wherein the charge-transporting agents having an arylamino group in the molecule are one or more p-terphenyl compounds represented by the following general formula (7):

(7)

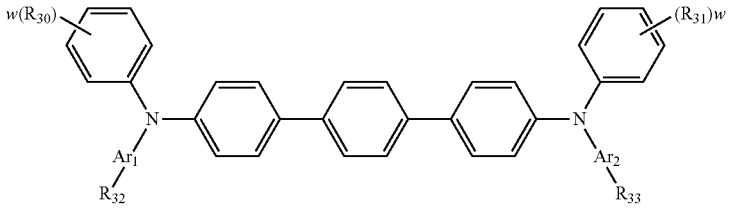

wherein $R_{30}$ and $R_{31}$ may be the same or different and each represent a hydrogen atom, an alkyl group having 1-8 carbon atoms, an alkoxy group having 1-8 carbon atoms, a halogen atom, or a mono- or di-substituted amino group; w represents the number of $R_{30}$ or $R_{31}$ groups and is an integer of 1 or 2; when w=2, then the two substituents bonded to the same phenyl group may be the same or different; $Ar_1$ and $Ar_2$ may be the same or different and each represent a substituted or unsubstituted divalent aromatic hydrocarbon group; and $R_{32}$ and $R_{33}$ each represent a hydrogen atom, an alkyl group having 1-8 carbon atoms, an alkoxy group having 1-8 carbon atoms, a substituted or unsubstituted aralkyl group, a halogen atom, or a di-substituted amino group.

9. The photoreceptor for electrophotography according to claim 8, wherein the cyclic phenol sulfide represented by general formula (1) is contained in an amount of 0.01-1.0% by mass based on the amount of the charge-transporting agents used which have an arylamino group in the molecule.

10. The photoreceptor for electrophotography according to claim 1, wherein the cyclic phenol sulfide represented by general formula (1) is contained in an amount of 0.01-1.0% by mass based on the amount of the charge-transporting agents used which have an arylamino group in the molecule.

* * * * *

UNITED STATES PATENT AND TRADEMARK OFFICE

CERTIFICATE OF CORRECTION

PATENT NO. : 8,247,144 B2
APPLICATION NO. : 12/524213
DATED : August 21, 2012
INVENTOR(S) : M. Koike et al.

It is certified that error appears in the above-identified patent and that said Letters Patent is hereby corrected as shown below:

At column 22, line 19 (claim 2, line 36) of the printed patent, please delete "it" after when.

At column 24, line 45 (claim 6, line 31) of the printed patent, please delete ")" after different.

Signed and Sealed this
Twelfth Day of March, 2013

Teresa Stanek Rea
*Acting Director of the United States Patent and Trademark Office*